US010636567B2

(12) United States Patent
Makino et al.

(10) Patent No.: US 10,636,567 B2
(45) Date of Patent: Apr. 28, 2020

(54) HEAT TREATMENT APPARATUS FOR LAMINATED BODY OF AMORPHOUS ALLOY RIBBON AND SOFT MAGNETIC CORE

(71) Applicants: TOHOKU UNIVERSITY, Miyagi (JP); Panasonic Corporation, Osaka (JP)

(72) Inventors: Akihiro Makino, Miyagi (JP); Nobuyuki Nishiyama, Miyagi (JP); Terutsugu Segawa, Osaka (JP); Tohru Kojima, Osaka (JP); Yukio Nishikawa, Osaka (JP)

(73) Assignees: TOHOKU MAGNET INSTITUTE CO., LTD., Miyagi (JP); PANASONIC CORPORATION, Osaka (JP)

( * ) Notice: Subject to any disclaimer, the term of this patent is extended or adjusted under 35 U.S.C. 154(b) by 156 days.

(21) Appl. No.: 15/426,339

(22) Filed: Feb. 7, 2017

(65) Prior Publication Data

US 2017/0229237 A1 Aug. 10, 2017

(30) Foreign Application Priority Data

Feb. 9, 2016 (JP) ..... 2016-023037
Jan. 12, 2017 (JP) ..... 2017-003608

(51) Int. Cl.
*H01F 41/02* (2006.01)
*H01F 27/25* (2006.01)
(Continued)

(52) U.S. Cl.
CPC ..... *H01F 41/0226* (2013.01); *C21D 1/34* (2013.01); *C22C 45/02* (2013.01); *H01F 27/25* (2013.01);
(Continued)

(58) Field of Classification Search
None
See application file for complete search history.

(56) References Cited

U.S. PATENT DOCUMENTS 5,179,776 A * 1/1993 Boenitz ..... H01F 41/024 29/609
5,509,975 A * 4/1996 Kojima ..... B22F 3/006 148/104
(Continued)

FOREIGN PATENT DOCUMENTS

JP 2003-213331 7/2003
JP 2004-353090 12/2004
(Continued)

OTHER PUBLICATIONS

Harakawa et al., "Preparation of Flaky Amorphous Powders", Journal of Japan Society Colour Material, Japan Society Colour Material, 1994, vol. 67, No. 12, pp. 817-822, English Abstract on p. 822.

*Primary Examiner* — Kevin M Bernatz
(74) *Attorney, Agent, or Firm* — Wenderoth, Lind & Ponack, L.L.P.

(57) ABSTRACT

A heat treatment apparatus for a laminated body of amorphous alloy ribbon includes: a lamination jig that holds the laminated body of amorphous alloy ribbon; two heating plates that sandwich the laminated body from upper and lower surfaces in a lamination direction without coming into contact with the lamination jig; and a heating control apparatus that controls a heating temperature of the two heating plates.

11 Claims, 6 Drawing Sheets

(51) Int. Cl.
*C22C 45/02* (2006.01)
*C21D 1/34* (2006.01)

(52) U.S. Cl.
CPC ..... *C21D 2201/03* (2013.01); *C22C 2202/02* (2013.01)

(56) References Cited

U.S. PATENT DOCUMENTS

| | | | | |
|---|---|---|---|---|
| 6,083,325 | A * | 7/2000 | Bitoh | H01F 1/15341 148/121 |
| 6,425,960 | B1 | 7/2002 | Yoshizawa et al. | |
| 7,935,196 | B2 | 5/2011 | Ohta et al. | |
| 2010/0108196 | A1 | 5/2010 | Ohta et al. | |
| 2014/0132376 | A1* | 5/2014 | Jin | H01F 1/0552 335/302 |
| 2017/0154713 | A1* | 6/2017 | Simon | B22F 3/1055 |

FOREIGN PATENT DOCUMENTS

| | | |
|---|---|---|
| JP | 2007-270271 | 10/2007 |
| JP | 2008-231534 | 10/2008 |
| JP | 2015-56424 | 3/2015 |

* cited by examiner

Fig. 3A
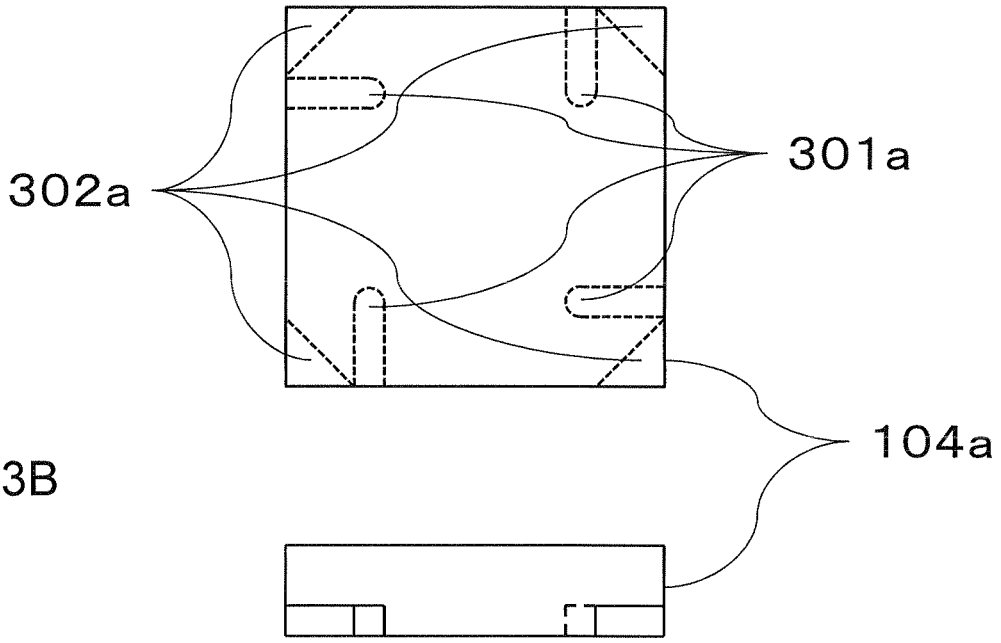
Fig. 3B
Fig. 3C
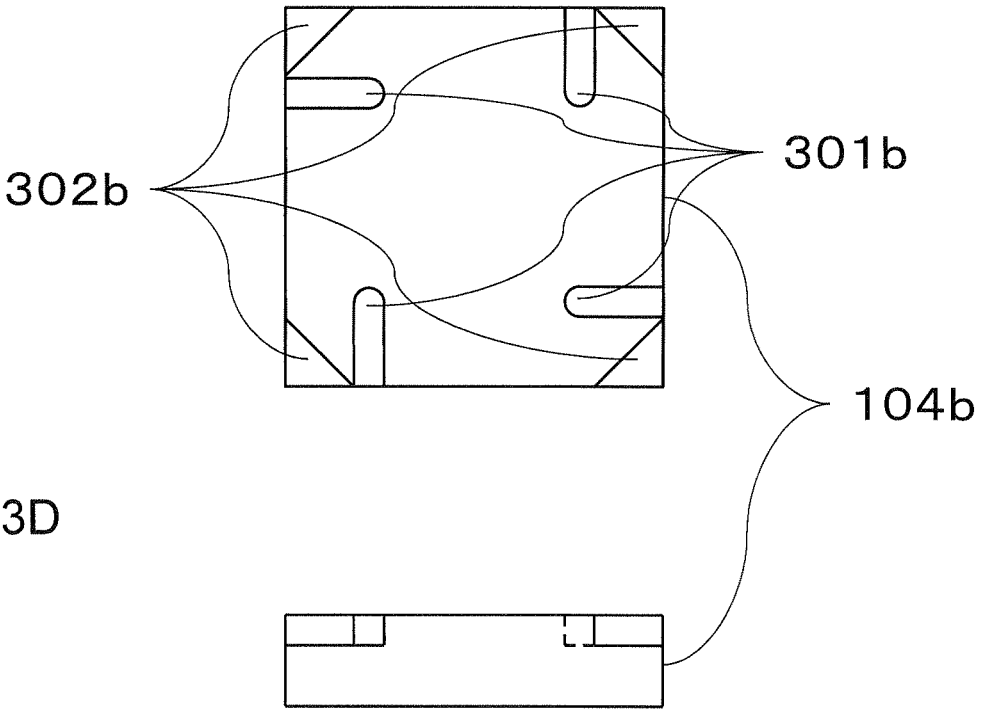
Fig. 3D

HEAT TREATMENT APPARATUS FOR LAMINATED BODY OF AMORPHOUS ALLOY RIBBON AND SOFT MAGNETIC CORE

BACKGROUND OF THE INVENTION

1. Field of the Invention

The present invention relates to a heat treatment apparatus for a laminated body of nanocrystal alloy ribbon used for magnetic heads, transformers, choke coils, etc., or particularly, for amorphous alloy ribbon having low iron loss and coercive force and excellent soft magnetic properties, and a lamination jig thereof, as well as a soft magnetic core acquired by a heat treatment of an Fe-based amorphous alloy.

2. Description of the Related Art

A laminated body of amorphous alloy ribbon is used as a soft magnetic core in magnetic heads, transformers, choke coils, etc. Additionally, since an Fe-based nanocrystal alloy is a soft magnetic material capable of satisfying both a high saturation magnetic flux density and a low coercive force, the amorphous alloy ribbon is recently heat-treated and used as a laminated body.

The Fe-based nanocrystal alloy is an alloy containing Fe as a main element that is an essential element responsible for magnetism. In manufacturing of a soft magnetic core using this Fe-based nanocrystal alloy, it is necessary to laminate a ribbon of an alloy composition having an amorphous structure to form a core, and to apply a heat treatment to the core so as to precipitate fine bcc-Fe crystals. It is noted that Bcc stands for a body-centered cubic lattice structure.

However, when bcc-Fe crystals are precipitated by the heat treatment, an excessive temperature rise occurs due to self-heating associated with the crystallization of the bcc-Fe crystals, resulting in a problem of occurrence of the enlargement of crystal grains of the bcc-Fe crystals and the deterioration in soft magnetic properties due to precipitation of an Fe compound such as Fe—B and Fe—P.

The countermeasures to the conventional problem described above include terminating a first heat treatment to a quenched body mainly composed of Fe in the amorphous phase when heat generation associated with the crystallization of the bcc-Fe crystals starts, and applying a second heat treatment after the end of the heat generation of the crystallization (see, e.g., Japanese Patent Publication No. 2003-213331). As a result, fine bcc-Fe crystals are precipitated. The quenched body mainly composed of Fe mainly in the amorphous phase is acquired by quenching a high temperature liquid metal mainly composed of Fe.

The countermeasures to the conventional problem described above include providing an endothermic reactant on at least one surface of amorphous alloy ribbon (see, e.g., Japanese Patent Publication No. 2015-56424). The endothermic reactant has an endothermic reaction temperature between a first crystallization temperature at which the heat generation due to crystallization of bcc-Fe of the amorphous alloy ribbon starts and a second crystallization temperature at which the heat generation due to crystallization of the Fe compound starts. The excessive temperature rise is suppressed by disposing the endothermic reactant as described above before performing the heat treatment.

FIGS. 6A and 6B are views of an example of a method of manufacturing a conventional soft magnetic core described in Japanese Patent Publication No. 2015-56424. FIG. 6A is a perspective view of a soft magnetic core 601 before heat treatment acquired by toroidally-winding and laminating an amorphous alloy ribbon having a layer of an endothermic reactive material formed on one surface. FIG. 6B is a partially enlarged cross-sectional view taken along a plane A of FIG. 6A, and a layer of an endothermic reactant 603 is formed on one side of an amorphous alloy ribbon 602 so that the endothermic reactant 603 and the amorphous alloy ribbon 602 are alternately arranged by laminating the amorphous alloy ribbon 602.

In Japanese Patent Publication No. 2003-213331, it is described that in a method of detecting a start time point of self-heating due to crystallization of bcc-Fe crystals, the start time point can be detected by successively measuring an ambient temperature inside a heat-treating furnace and a temperature of a core of a laminated alloy composition having an amorphous structure at the same time to detect a time point at which a rate of increase in the temperature of the core becomes higher than a rate of increase in the ambient temperature.

However, since it is not practical to measure the core temperature of all the cores housed in the heat-treating furnace in consideration of the manufacturing cost, the cores must be limited in terms of the measurement of temperature. Therefore, the start time point of self-heating due to the crystallization of the bcc-Fe crystals varies in individual cores depending on a temperature condition according to a location in the furnace, a rate of temperature rise in the heat-treating furnace, or a size of a core, a variation in composition at the time of manufacturing of a core, etc. Thus, the temperature measurement of the limited cores results in deviation also in detection, and a delay occurs in the timing of stopping the temperature rise in some cores and leads to precipitation of an Fe compound because of overheating due to self-heating associated with crystallization, resulting in a problem of degradation in soft magnetic properties.

Even if the temperature rise is stopped by detecting the self-heating due to crystallization of bcc-Fe crystals, a time delay occurs before the furnace temperature drops. Therefore, the temperature rise due to self-heating continues for a while and, in the case of an amorphous alloy composition having a small difference between the bcc-Fe crystallization temperature (first crystallization temperature) and the crystallization temperature of the compound such as Fe—B (second crystallization temperature), the temperature inside the core exceeds the crystallization temperature of the Fe compound and the precipitation of the Fe compound results in a problem of degradation in soft magnetic properties.

In the configuration in Japanese Patent Publication No. 2015-56424, it is described that an endothermic reactant is disposed on at least one surface of the amorphous alloy ribbon to absorb self-heating associated with crystallization; however, since the disposition of the endothermic reactant reduces the space factor of the amorphous alloy ribbon relative to the core volume, the configuration has a problem of deterioration in the soft magnetic properties of the core.

SUMMARY OF THE INVENTION

The present invention solves the conventional problems and an object thereof is to provide a heat treatment apparatus for amorphous alloy ribbon capable of suppressing an influence of self-heating associated with crystallization of amorphous alloy without deteriorating the soft magnetic properties.

A heat treatment apparatus for a laminated body of amorphous alloy ribbon includes:

a lamination jig that holds the laminated body of amorphous alloy ribbon;

two heating plates that sandwich the laminated body from upper and lower surfaces in a lamination direction without coming into contact with the lamination jig; and a heating control apparatus that controls a heating temperature of the two heating plates.

As described above, the heat treatment apparatus for the laminated body of amorphous alloy ribbon according to the present invention can suppress the influence of self-heating occurring when the laminated body of amorphous alloy ribbon is crystallized by a heat treatment, and can perform the heat treatment without deteriorating the soft magnetic properties. As a result, a soft magnetic core acquired by this heat treatment apparatus can achieve high soft magnetic properties.

BRIEF DESCRIPTION OF THE DRAWINGS

FIG. 3A is a schematic plane view of an upper heating plate in the first embodiment viewed from above;

FIG. 3B is a schematic side view of the upper heating plate;

FIG. 3C is a schematic plane view of a lower heating plate viewed from above;

FIG. 3D is a schematic side view of the lower heating plate;

DETAILED DESCRIPTION

Figure 1:
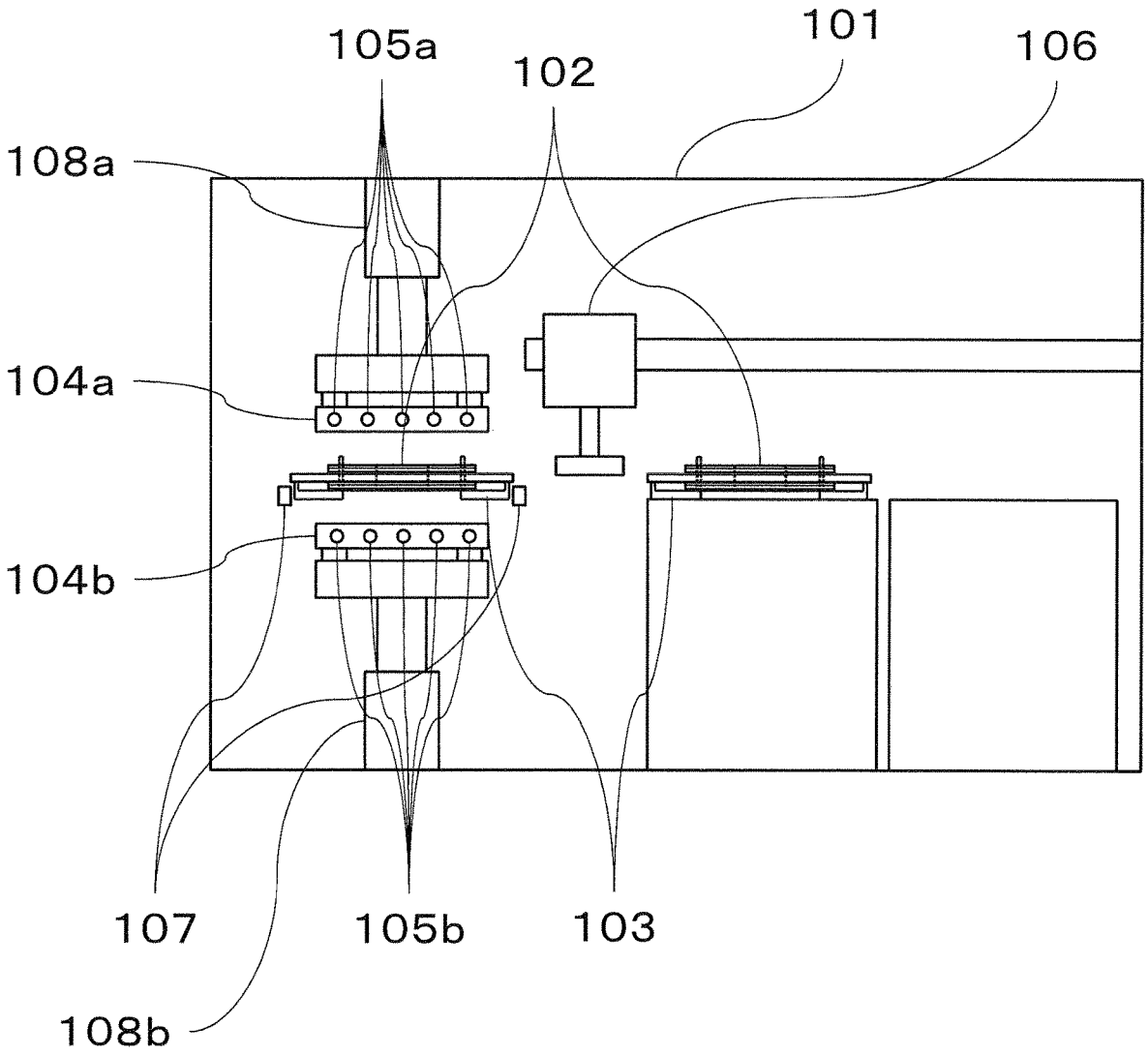
FIG. 1 is a structural diagram of a configuration of a heat treatment apparatus for amorphous alloy ribbon according to a first embodiment.

As a heat treatment apparatus for a laminated body of amorphous alloy ribbon of a first aspect, a heat treatment apparatus includes:

a lamination jig that holds the laminated body of amorphous alloy ribbon;

two heating plates that sandwich the laminated body from upper and lower surfaces in a lamination direction without coming into contact with the lamination jig; and a heating control apparatus that controls a heating temperature of the two heating plates.

As a heat treatment apparatus for a laminated body of amorphous alloy ribbon of a second aspect, in the first aspect, the two heating plates may be larger than a planar shape perpendicular to the lamination direction of the laminated body and are not in contact with the laminated body at a portion including a position at which the amorphous alloy ribbon is held by the lamination jig.

With the configuration, the heat treatment of the laminated body can be performed while maintaining the in-plane uniformity of temperature of the two heating plates.

As a heat treatment apparatus for a laminated body of amorphous alloy ribbon of a third aspect, in the first or second aspect, the lamination jig may have a mechanism following contraction at the time of crystallization of the amorphous alloy ribbon.

According to the configuration, since the lamination jig has a mechanism following the contraction of the amorphous alloy ribbon, the amorphous alloy ribbon can be restrained from being deformed or damaged by the lamination jig holding the laminated body when the amorphous alloy ribbon contracts at the time of crystallization.

As a heat treatment apparatus for a laminated body of amorphous alloy ribbon of a fourth aspect, in any one of the first to third aspects, the heat treatment apparatus may further include: a pressurization drive mechanism that sandwiches and pressurizes the laminated body from upper and lower surfaces in the lamination direction between the two heating plates, wherein the lamination jig may hold the laminated body in a plane intersecting with the lamination direction of the laminated body.

As a heat treatment apparatus for a laminated body of amorphous alloy ribbon of a fifth aspect, in any one of the first to fourth aspects, the lamination jig may hold the laminated body with at least two supports intersecting with a radial direction extending from the center of the laminated body in a plane intersecting with the lamination direction of the laminated body.

As a heat treatment apparatus for a laminated body of amorphous alloy ribbon of a sixth aspect, in any one of the first to fifth aspects, the amorphous alloy ribbon may be a Fe-based alloy ribbon, and the heating control apparatus may control the two heating plates within a temperature range from 400° C. or more to 500° C. or less.

As a heat treatment apparatus for a laminated body of amorphous alloy ribbon of a seventh aspect, in any one of the first to sixth aspects, the heat treatment apparatus may further include:

a jig placing mechanism that places the lamination jig between the two heating plates; and a conveying apparatus that disposes the laminated body along with the lamination jig onto the jig placing mechanism.

As a soft magnetic core made up of a laminated body of laminated Fe-based alloy ribbons of a eighth aspect, the Fe-based alloy ribbons of the laminated body have relatively-high crystallization percentage portions having the same shape and overlapping in the lamination direction and relatively-low crystallization percentage portions having the same shape and overlapping in the lamination direction.

As a soft magnetic core made up of a laminated body of laminated Fe-based alloy ribbons of a ninth aspect, in the eighth aspect, the soft magnetic core may have an uncolored portion on a contact surface between the Fe-based alloy ribbons in the laminated body.

As a soft magnetic core made up of a laminated body of laminated Fe-based alloy ribbons of a tenth aspect, in the ninth aspect, the uncolored portion may be surrounded by the colored portion in an outer shape in a planar view of the laminated body.

As a soft magnetic core made up of a laminated body of laminated Fe-based alloy ribbons of a eleventh aspect, in the tenth aspect, the laminated body may be colored by a heat treatment so that a degree of the heat treatment is visibly recognizable.

A heat treatment apparatus for a laminated body of amorphous alloy ribbon and a soft magnetic core according to embodiments will now be described with reference to the accompanying drawings. In the drawings, substantially the same members are denoted by the same reference numerals.

First Embodiment

<Configuration of Heat Treatment Apparatus for Laminated Body of Amorphous Alloy Ribbon>

FIG. 1 is a structural diagram of a configuration of a heat treatment apparatus 101 for a laminated body of amorphous alloy ribbon in a first embodiment.

The heat treatment apparatus 101 for a laminated body 102 of amorphous alloy ribbon has a lamination jig 103 that holds the laminated body 102 of amorphous alloy ribbon, and two heating plates 104*a*, 104*b* that sandwich the laminated body 102 from upper and lower surfaces in the lamination direction. The heat treatment apparatus 101 further includes a heating control device (not shown) that controls the heating temperature of the two heating plates 104*a*, 104*b*, and a pressurization drive mechanism 108*a* that sandwiches and pressurizes the laminated body 102 between the two heating plates 104*a*, 104*b* from the upper and lower surfaces in the lamination direction. The two heating plates 104*a*, 104*b* do not come into contact with the lamination jig 103.

The heat treatment apparatus 101 for the laminated body 102 of amorphous alloy ribbon has the two heating plates 104*a*, 104*b* sandwiching the laminated body 102 of amorphous alloy ribbon from the upper and lower surfaces in the lamination direction. The laminated body 102 of amorphous alloy ribbon is heated by these two heating plates 104*a*, 104*b*. On the other hand, when an excessive temperature rise occurs due to self-heating at the time of crystallization of the amorphous alloy ribbon, heat is transferred from the laminated body 102 of the amorphous alloy ribbon to the two heating plates 104*a*, 104*b* so that the excessive temperature rise of the amorphous alloy ribbon 102 can be suppressed. As a result, a soft magnetic core having fine alloy crystals can be acquired from the amorphous alloy ribbon.

The heat treatment apparatus 101 for the laminated body 102 of amorphous alloy ribbon may include a jig placing mechanism 107 placing the lamination jig 103 between the two heating plates 104*a*, 104*b*, and a conveying apparatus 106 disposing the laminated body 102 along with the lamination jig 103 onto the jig placing mechanism 107.

<Laminated Body of Amorphous Alloy Ribbon>

The laminated body of amorphous alloy ribbon undergoing the heat treatment is, for example, a laminated body of amorphous Fe-based alloy ribbon. The Fe-based alloy may contain Fe as a main component along with slight impurities such as B, P, Cu, Si, and C. The thickness of each layer of the amorphous alloy ribbon is, for example, within a range from 10 μm or more to 100 μm or less and may be within a range from 20 μm or more to 50 μm. The laminated body 102 of the amorphous Fe-based alloy ribbon has, for example, several to less than 40 laminated layers of the amorphous alloy ribbon, and has the thickness less than 2 mm, for example.

<Lamination Jig>

Figure 2A:
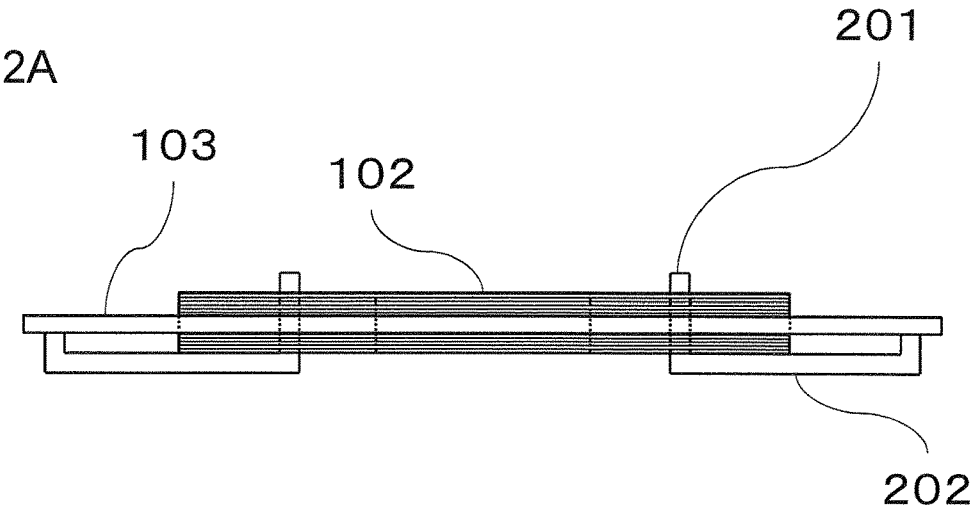
FIG. 2A is a schematic side view of a lamination jig in the embodiment.
Figure 2B:
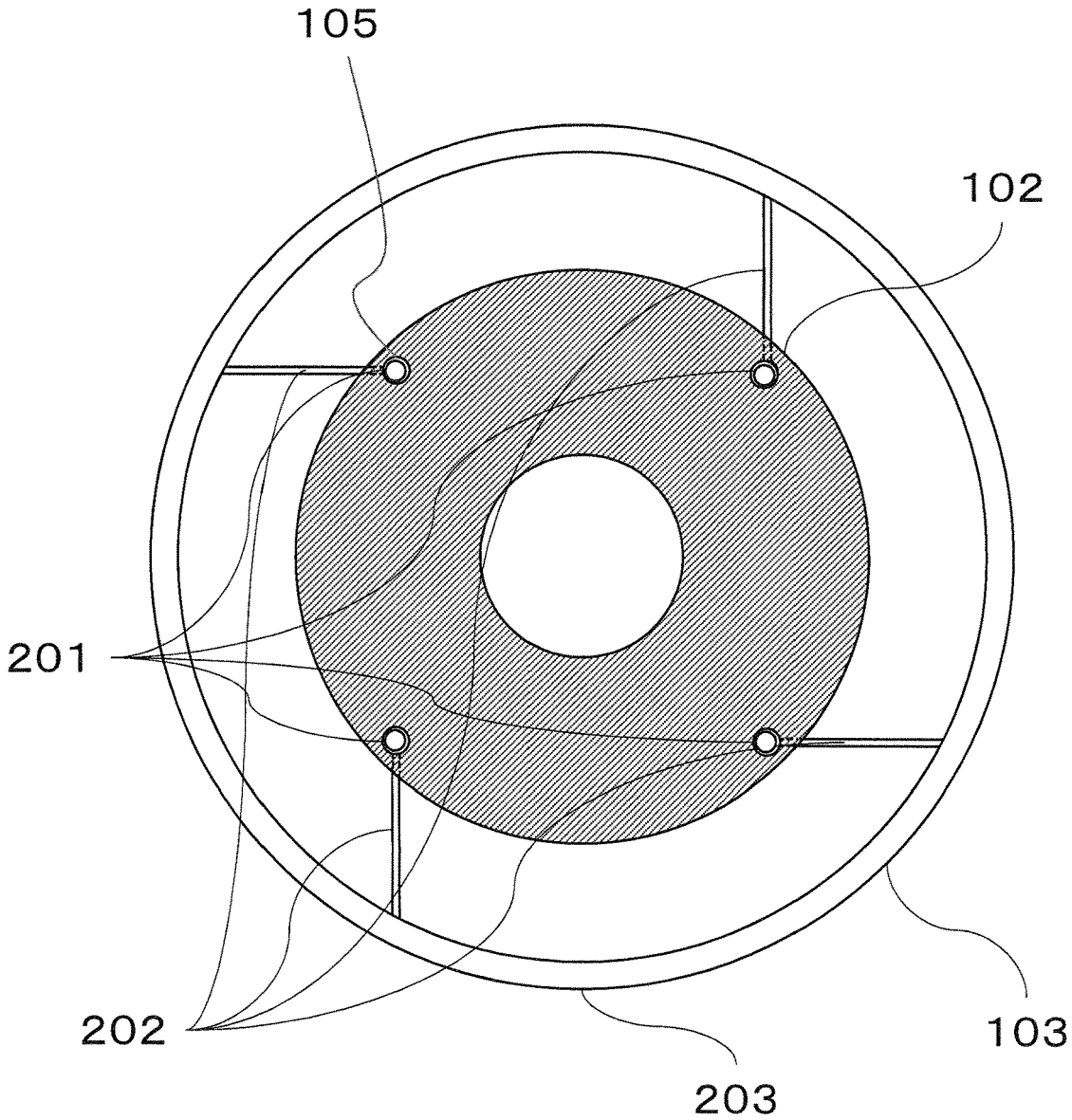
FIG. 2B is a schematic plane view of the lamination jig in the first embodiment.

FIGS. 2A and 2B show the lamination jig 103 and the laminated amorphous alloy ribbon 102, and FIG. 2A is a side view, while FIG. 2B is a view from above.

In FIG. 1, the laminated body 102 of amorphous alloy ribbon is laminated and supported while being positioned on the lamination jig 103. The lamination jig 103 holds the laminated body 102 of amorphous alloy ribbon in a plane intersecting with the lamination direction of the laminated body 102 of amorphous alloy ribbon. The lamination jig 103 is disposed with a ring-shaped jig frame 103 larger than a planar shape of the laminated body 102 of amorphous alloy ribbon perpendicular to the laminating direction, positioning pins 201 entering holes 105 arranged in the amorphous alloy ribbon 102 for positioning, and positioning pin connecting parts 202 connecting the positioning pins 201 and the jig frame 203. In the plane intersecting with the laminating direction of the laminated body 102 of amorphous alloy ribbon, the lamination jig 103 holds the laminated body 102 of amorphous alloy ribbon with at least two sets of the positioning pins 201 and the positioning pin connecting parts 202 intersecting with the radial direction extending from the center of the laminated body 102 of amorphous alloy ribbon. The positioning pin connecting parts 202 have a shape bendable in the horizontal direction. When the amorphous alloy ribbon 102 contracts, the positioning pins 201 and the positioning pin connecting parts 202 can move in directions of arrows so as to follow the contraction of the amorphous alloy ribbon 102. As a result the amorphous alloy ribbon 102 can be restrained from being deformed or damaged at the time of contraction.

Additionally, the jig placing mechanism 107 and the conveying mechanism 106 may be included for placing the amorphous alloy ribbon 102 laminated on the lamination jig 103 between the two heating plates 104*a*, 104*b*. The pressurization drive mechanisms 108*a*, 108*b* may be included for driving the two heating plates 104*a*, 104*b* to contact and pressurize the amorphous alloy ribbon 102.

<Heating Plates>

FIGS. 3A to 3D are schematic plane views and schematic side views of the two heating plates 104*a*, 104*b*. FIG. 3A is a plane view of the upper heating plate 104*a* viewed from above. FIG. 3B is a side view from a side (fixing screw holes and a heater 105*a* of the upper heating plate are not shown). FIG. 3C is a view of the lower heating plate 104*b* viewed from above. FIG. 3D is a side view from a side (fixing screw holes and a heater 105*b* of the lower heating plate are not shown).

The two heating plates 104*a*, 104*b* are disposed with the respective heaters 105*a*, 105*b* and are disposed with a heating control apparatus (not shown) controlling electric power applied to these heaters 105*a*, 105*b*. The two heating plates 104*a*, 104*b* can be driven by the pressurization drive mechanisms 108*a*, 108*b* to sandwich and pressurize the laminated body from the upper and lower surfaces in the lamination direction. As a result, a contact thermal resistance can be reduced between the laminated body 102 of the amorphous alloy ribbon and the two heating plates 104*a*, 104*b*. Therefore, when an excessive temperature rise occurs due to self-heating at the time of crystallization of the amorphous alloy ribbon, heat is transferred from the laminated body 102 of the amorphous alloy ribbon to the two heating plates 104*a*, 104*b*, so that the excessive temperature rise of the amorphous alloy ribbon 102 can be suppressed. As a result, a soft magnetic core having fine alloy crystals can be acquired from the amorphous alloy ribbon.

The two heating plates 104*a*, 104*b* each have recess structures formed as positioning pin part escape structures 301*a*, 301*b* and jig frame part escape structures 302*a*, 302*b*. As a result, when the two heating plates 104*a*, 104*b* and the laminated body 102 of amorphous alloy ribbon are brought into contact with each other, the two heating plates 104*a*, 104*b* and the lamination jig 103 can be prevented from coming into contact with each other.

<Method of Heat Treatment of Laminated Body 102 of Amorphous Alloy Ribbon>

A method of heat treatment of the laminated body 102 of amorphous alloy ribbon by the heat treatment apparatus 101 for the laminated body 102 of amorphous alloy ribbon will be described with reference to FIG. 1.

(1) The electric power applied to the heaters 105*a*, 105*b* is controlled by the heating control apparatus to heat the two heating plates 104*a*, 104*b* and stabilize the temperature in advance. In this case, the two heating plates 104*a*, 104*b* are set to a temperature higher than the crystallization temperature of the bcc-Fe crystals of the amorphous alloy ribbon 102 and lower than the crystallization temperature of the precipitation of the Fe compound causing a deterioration in soft magnetic properties. For example, in the case of using the amorphous Fe-based alloy as the amorphous alloy ribbon, the crystallization temperature is about 400° C., and the temperature of formation of the Fe compound in another phase is about 530° C. Therefore, for example, the temperature may be set within a temperature range from 400° C. or more to 500° C. or less.

(2) The amorphous alloy ribbon 102 is then laminated on the lamination jig 103 and is put into the heat treatment apparatus 101 for amorphous alloy ribbon. The input amorphous alloy ribbon 102 is placed along with the lamination jig 103 on the jig placing mechanism 107 by the conveying mechanism 106.

(3) The two heated heating plates 104*a*, 104*b* are then driven to contact and pressurize the amorphous alloy ribbon 102 by the pressurization drive mechanisms 108*a*, 108*b* so as to heat and crystallize the amorphous alloy ribbon 102. When self-heating occurs at the time of crystallization of the amorphous alloy ribbon 102 and the temperature of the amorphous alloy ribbon 102 becomes higher than the temperature of the two heating plates 104*a*, 104*b*, the two heating plates 104*a*, 104*b* act as cooling plates. As a result, heat is transferred and absorbed from the amorphous alloy ribbon 102 to the two heating plates 104*a*, 104*b*, and a temperature rise due to the self-heating of the amorphous alloy ribbon 102 can be suppressed. Consequently, the amorphous alloy ribbon 102 can be restrained from reaching a high temperature causing a deterioration in the soft magnetic properties. The contact/pressurization of the two heating plates 104*a*, 104*b* with the amorphous alloy ribbon 102 can reduce the thermal contact resistance between the amorphous alloy ribbon 102 and the two heating plates 104*a*, 104*b*. As a result, the heat can efficiently be transferred to the amorphous alloy ribbon 102 at the time of heating. On the other hand, at the time of self-heating associated with the crystallization of the amorphous alloy ribbon 102, the heat can promptly be transferred from the amorphous alloy ribbon 102 to the two heating plates 104*a*, 104*b* so that the excessive temperature rise due to the self-heating can efficiently be suppressed.

Although the amorphous alloy ribbon 102 contracts during this heat treatment, the positioning pins 201 of the lamination jig 103 move because of bending of the positioning pin connecting parts 202 so that the amorphous alloy ribbon 102 is restrained from being deformed or damaged.

(4) The two heating plates 104*a*, 104*b* are then opened by the pressurization drive mechanisms 108*a*, 108*b* to release the contact between the laminated body of the alloy ribbon 102 after the heat treatment and the two heating plates 104*a*, 104*b*.

(5) Subsequently, after recovering the heat-treated laminated body 102 of the alloy ribbon along with the lamination jig 103 by the conveying mechanism 106, the heat-treated laminated body 102 of the alloy ribbon is taken out from the lamination jig.

Through the steps described above, the amorphous alloy ribbon 102 can be subjected to a crystallization treatment to acquire a soft magnetic core.

<Result: Soft Magnetic Core>

Figure 4:
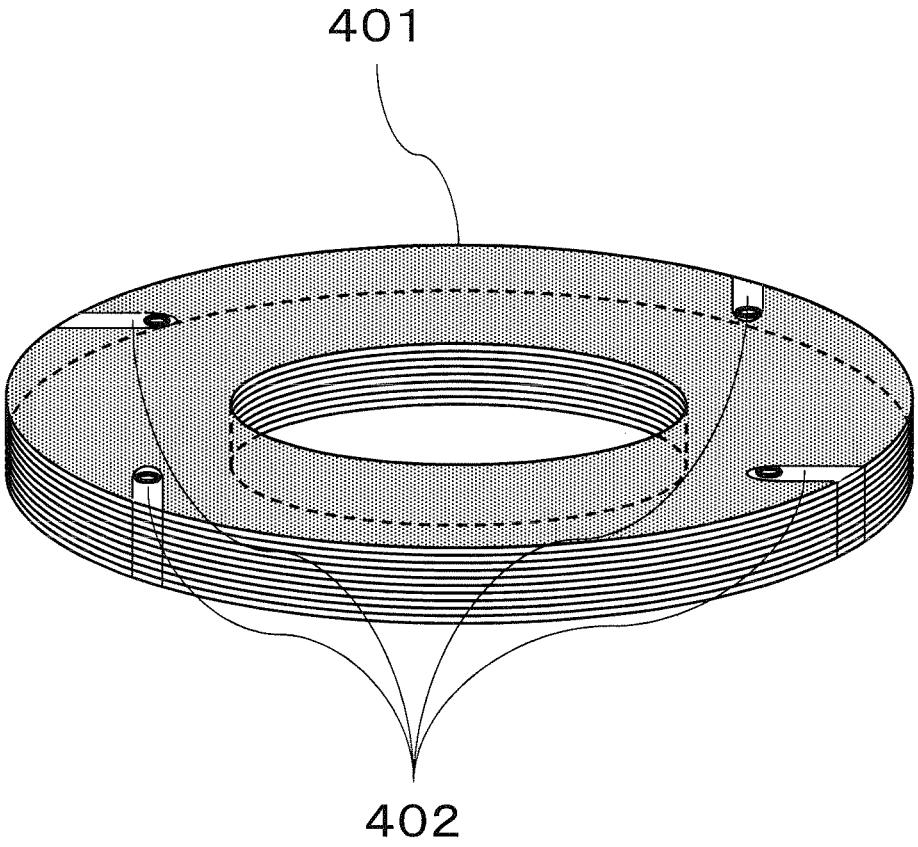
FIG. 4 is a schematic of a soft magnetic core according to the first embodiment.

With this configuration, the laminated body 102 of amorphous alloy ribbon can be crystallized and used as a soft magnetic core. FIG. 4 shows a soft magnetic core 401 crystallized by performing the heat treatment with this configuration.

The soft magnetic core 401 has portions 402 less crystallized as compared to the other portion since the amorphous alloy ribbon 102 and the two heating plates 104*a*, 104*b* are not brought into contact with each other during the heat treatment because of the positioning pin part escape structures 301*a*, 302*b* arranged on the two heating plates. In particular, the volume fraction of crystals is 50% or more in the portions contacted with the heating plates 104*a*, 104*b* and is less than 50% in the less crystallized portions 402. In this case, the layers of the alloy ribbon have relatively-high crystallization percentage portions having the same shape and overlapping in the lamination direction and relatively-low crystallization percentage portions having the same shape and overlapping in the lamination direction.

The less crystallized portions 402 are inferior in the saturation magnetic flux density and the soft magnetic properties and therefore must be designed not to be arranged in a region required to be high in these characteristics.

Figure 5:
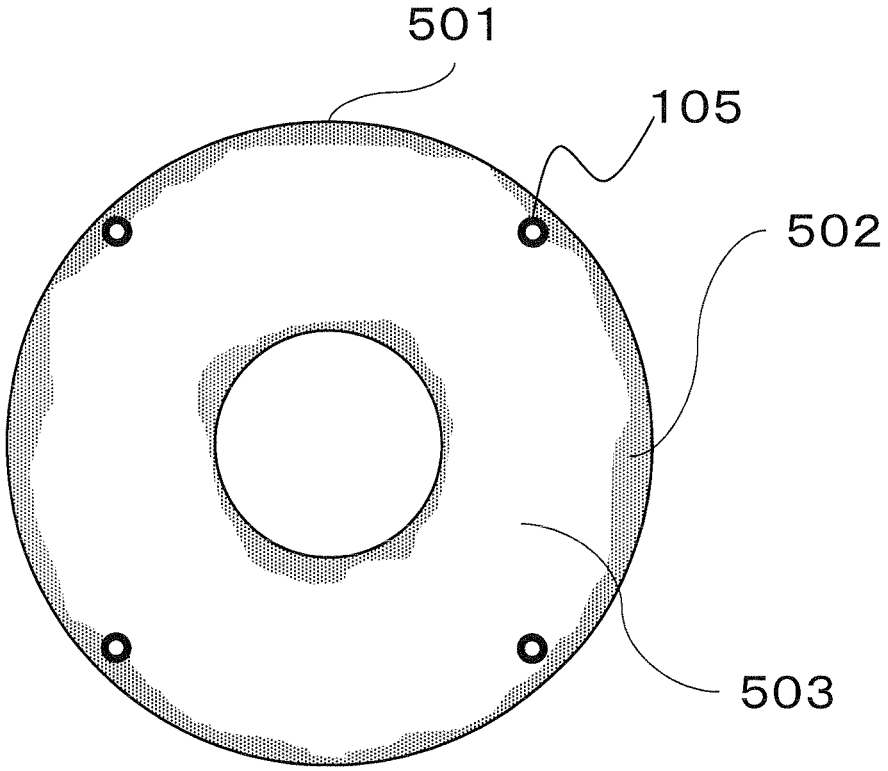
FIG. 5 is a schematic of a contact surface of an amorphous alloy ribbon of the soft magnetic core according to the embodiment.
Figure 6A:
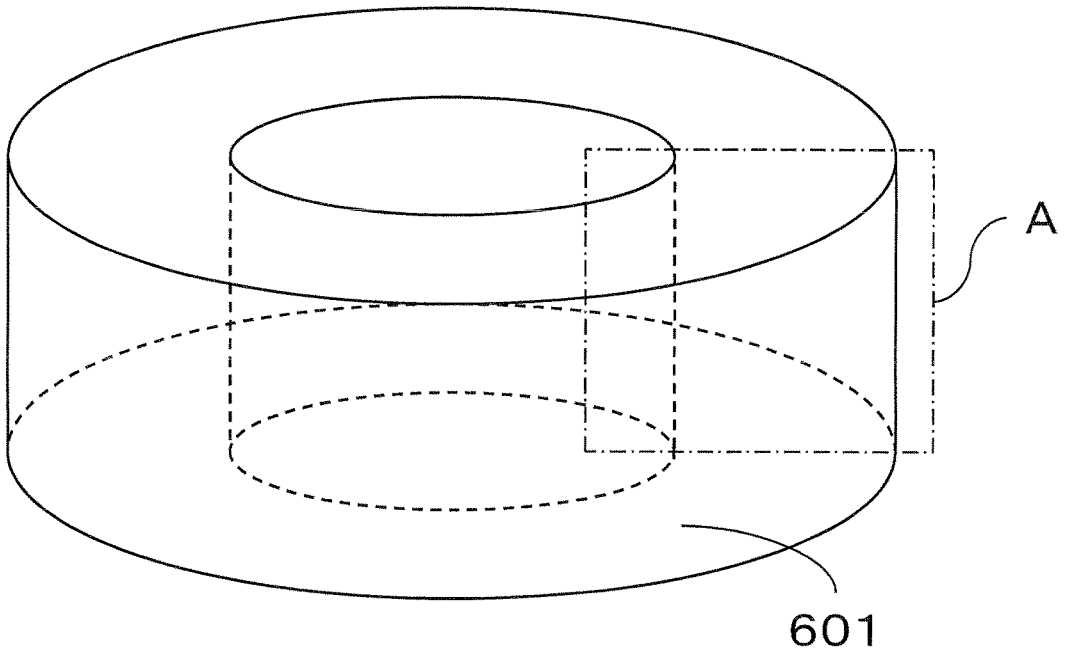
FIG. 6A is a perspective view of a conventional laminated soft magnetic core described in Japanese Patent Publication No. 2015-56424.
Figure 6B:
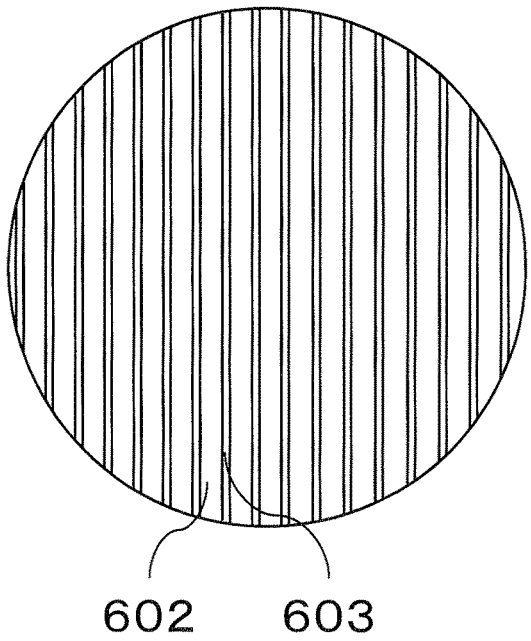
FIG. 6B is a partially enlarged cross-sectional view taken along a plane A of FIG. 6A.

The laminated body of the soft magnetic core 401 is separated into alloy ribbons 501 shown in FIG. 5. Each of the alloy ribbons 501 has a colored portion 502 in the vicinity of an outer shape portion of the alloy ribbon 501. However, the alloy ribbon 501 has an uncolored portion 503 remaining inside. This is related to the fact that a gap allowing oxygen to pass through between the ribbons is narrow because of pressurization during the heat treatment. The range of the colored portion 502 depends on an adhesion state between the ribbons constituting the laminated body and also depends on in-plane variations in thickness of the amorphous alloy ribbon 102 as well as a pressurizing force from the pressurization drive mechanisms 108*a*, 108*b*.

The colored portion 502 is blue to purple. On the other hand, the uncolored portion 503 between ribbons has metallic luster. By checking the coloration due to the heat treatment, a degree of the heat treatment can be determined. Specifically, a portion not properly heat-treated has a color other than blue to purple, for example, yellow or brown, or pale blue to purple or dark blue to purple. Particularly, if the temperature of the alloy ribbon becomes too high due to self-heating associated with crystallization, the surface color turns white. Additionally, from the colors of the side, upper, and lower surfaces of the soft magnetic core 401, it can be seen whether the heat treatment is achieved in each portion. The degree of heat treatment of the soft magnetic core 401 as a whole can be determined by visually recognizing the color.

The quality of the colored part 502 can be determined by visually recognizing the color.

CONCLUSION

According to this configuration, by driving the two heating plates to contact and pressurize the laminated body of amorphous alloy ribbon, the influence of self-heating and contraction occurring at the time of crystallization by a heat treatment can be suppressed, and the heat treatment can be performed without deteriorating the soft magnetic properties, so that a core with high soft magnetic properties can be acquired.

In this embodiment, the lamination jig 103 is configured to be positioned for lamination by inserting the positioning pins 201 into the holes formed in the amorphous alloy ribbon 102; however, the lamination jig 103 may be configured to restrict a portion or the whole of the outer shape of the amorphous alloy ribbon. In this case, a restricting part thereof is configured to follow the contraction of the amorphous alloy ribbon.

In this embodiment, the planar shape of the two heating plates 104*a*, 104*b* is rectangular; however, the planar shape may be circular or other shapes. In the case of a circular shape, the needs for the jig frame part escape structures 302*a*, 302*b* arranged in the heating plates can be eliminated.

Although the amorphous alloy ribbon 102 is placed on the jig placing mechanism 107 so as to arrange the amorphous alloy ribbon 102 between the two heating plates 104*a*, 104*b* along with the lamination jig 103 in this embodiment, this is not a limitation. For example, while the conveying mechanism 106 holds the amorphous alloy ribbon 102 along with the lamination jig 103, the two heating plates 104*a*, 104*b* may be closed by the pressurization drive mechanisms 108*a*, 108*b*.

This disclosure includes appropriately combining arbitrary embodiments and/or examples of the various embodiments and/or examples described above so that the effects of the respective embodiments and/or examples can be produced.

The heat treatment apparatus for amorphous alloy ribbon of the present invention can suppress the influence of self-heating and contraction occurring at the time of crystallization by a heat treatment and perform the heat treatment without deteriorating the soft magnetic properties. Therefore, this heat treatment apparatus is also applicable to laminating and heating treatments of sheet materials etc. generating heat due to a chemical reaction.

EXPLANATIONS OF LETTERS OR NUMBERS

101 heat treatment apparatus for amorphous alloy ribbon
102 amorphous alloy ribbon or laminated body thereof
103 lamination jig
104*a* heating plate
104*b* heating plate
105*a* heater
105*b* heater
106 conveying mechanism
107 jig placing mechanism
108*a* pressurization drive mechanism
201 positioning pin
202 positioning pin connecting parts
203 jig frame
301*a* structure
302*a* structure
401 soft magnetic core
402 portions less crystallized
501 crystallized alloy ribbon
502 colored portion of alloy ribbon
503 uncolored portion of alloy ribbon
601 soft magnetic core
602 amorphous alloy ribbon
603 endothermic reactant

What is claimed is:

1. A soft magnetic core comprising:
a laminated body of laminated Fe-based alloy ribbons, wherein:
each of the laminated Fe-based alloy ribbons has a same shape and two or more holes;
the laminated Fe-based alloy ribbons have high crystallization percentage portions and low crystallization percentage portions that are less crystallized than the high crystallization percentage portions;
the high crystallization percentage portions overlap, and the low crystallization percentage portions overlap in a planar view of the laminated body; and
the low crystallization percentage portions are at an outside of the laminated body and the two or more holes, and the high crystallization percentage portions are at an inside of the laminated body.

2. The soft magnetic core according to claim 1, further comprising low oxidized portions and high oxidized portions on a contact surface between the laminated Fe-based alloy ribbons in the laminated body.

3. The soft magnetic core according to claim 2, wherein the low oxidized portions are surrounded by the high oxidized portions in an outer shape in the planar view of the laminated body.

4. The soft magnetic core according to claim 3, wherein the laminated body has the low oxidized portions and the high oxidized portions by a heat treatment so that a degree of the heat treatment is visibly recognizable.

5. The soft magnetic core according to claim 2, wherein:
the two or more holes are first holes;
each of the laminated Fe-based alloy ribbons has one second hole in a center thereof;
the second hole is larger than the first holes; and
in each of the laminated Fe-based alloy ribbons:
the high crystallization percentage portions are at an outer edge and around the second hole; and
the low crystallization percentage portions are between the outer edge and around the second hole.

6. The soil magnetic core according to claim 1, wherein a volume fraction of crystals of the high crystallization percentage portions is 50% or more, and a volume fraction of crystals of the low crystallization percentage portions is less than 50%.

7. The soft magnetic core according to claim 1, wherein all of the high crystallization percentage portions of the laminated Fe-based alloy ribbons overlap, and all of the low crystallization percentage portions of the laminated Fe-based alloy ribbons overlap.

8. The soft magnetic core according to claim 1; wherein:
the two or more holes are first holes;
each of the laminated Fe-based alloy ribbons has one second hole in a center thereof; and
the second hole is larger than the first holes.

9. The soft magnetic core according to claim 1, wherein at least one of the two or more holes of each of the laminated Fe-based alloy ribbons is at a same position with respect to a laminate direction.

10. The soft magnetic core according to claim 1, wherein, in each of the laminated Fe-based alloy ribbons:
the two or more holes are at an outer edge; and
the two or more holes are spaced at a same distance along a circumferential direction from each other.

11. The soft magnetic core according to claim 1, wherein, in each of the laminated Fe-based alloy ribbons, each of the low crystallization percentage portions is connected from one of the two or more holes to an outer edge.

* * * * *